United States Patent [19]

Davegårdh et al.

[11] 4,208,945

[45] Jun. 24, 1980

[54] METHOD OF AND DEVICE FOR PRESSING PYROTECHNICAL CHARGES

[75] Inventors: Tore Davegårdh; Nils Gellerstedt; Folke Sahlin, all of Karlskoga, Sweden

[73] Assignee: Aktiebolaget Bofors, Bofors, Sweden

[21] Appl. No.: 948,444

[22] Filed: Oct. 4, 1978

[30] Foreign Application Priority Data

Oct. 5, 1977 [SE] Sweden ..... 7711130

[51] Int. Cl.[2] ..... F42B 4/00

[52] U.S. Cl. ..... 86/20 R; 86/29

[58] Field of Search ..... 86/20 R, 20 A, 20 B, 86/21, 29; 102/37.8

[56] References Cited

U.S. PATENT DOCUMENTS 2,418,333 4/1947 Caldwell et al. ..... 86/29 X

*Primary Examiner*—Leland A. Sebastian

*Attorney, Agent, or Firm*—Pollock, Vande Sande & Priddy

[57] ABSTRACT

Improved apparatus and method are disclosed for compacting pyrotechnical charges into low strength cases. The charges are precompacted outside the cases and then inserted into the cases for final compaction.

9 Claims, 7 Drawing Figures

METHOD OF AND DEVICE FOR PRESSING PYROTECHNICAL CHARGES

TECHNICAL FIELD

The present invention relates to a method of and a device for pressing pyrotechnical charges, for instance illuminating charges, at high pressures, into cases which have low strength.

Pressed illuminating charges, so-called flare bodies, are primarily used for military purposes, as light-emitting means for illuminating shells and the like. The flare bodies are transported up to a certain height above the ground with the aid of a projectile or an aircraft, and are ignited, after which, on their way back towards the ground, due to combustion of the illuminating charge, they emit intense light, which illuminates the ground surface below. In order to limit the descending speed towards the ground, it is a common practice to have the illuminating charge suspended from a parachute.

BACKGROUND ART

In order that the combustion, during the descent towards the ground of the illuminating charge, shall take place only at the end facing the ground, the other sides of the illuminating charge are usually enclosed by an insulating layer, which prevents ignition of these parts of the illuminating charge.

It is previously known to use for example epoxy plastic mixed with a filling agent (e.g. asbestos) as an insulating material. The insulation is then cast around the flare body, which requires comparatively much work and, accordingly, involves high production costs. Further, the components comprised in epoxy plastic are liable to cause allergy, with symptoms such as itching, swelling and headaches for the personnel.

Owing to, inter alia, said disadvantages, attempts have been made to use pasteboard cases for insulation of the illuminating charges. For reasons of strength, it has not been possible to press the illuminating charges direct into thin-walled pasteboard cases with high compacting pressures. This is due to the high friction forces which arise between the illuminating charge and the case when the illuminating charge is compacted, as the illuminating charge, which before the compacting consists of a powdered or granulated material, will be compacted at the high pressures to about one-half of its original volume, in order to give a low porosity and, accordingly, a high strength.

In order to solve this problem, the pasteboard cases have either been provided with excessively thick and hard walls which, however, have had a detrimental influence on the resulting quality of the cases and the burning properties, or else methods other than pressing have been resorted to for compacting of the pyrotechnical charge. Thus, according to the Swedish Patent Specification No. 6123/71, a method is known according to which the case is filled through stamping, rather than pressing. For stamping, however, more bonding agent is required, which is to the detriment of the performances of the illuminating charge. On the other hand, using less bonding agent will impair the strength.

Further, in the German published application No. 1 261 791, a method has been proposed of pressing a pyrotechnical charge into a pasteboard case without the case's being creased, by coating the inside of the case with a thin film of paper or plastic. This film creases during the pressing, and gives a low friction against the walls of the case, and therefore a pressed body with a homogeneous density can be obtained. However, the creases which become included have a detrimental influence on the strength, and cause a less uniform burning velocity.

DISCLOSURE OF INVENTION

The purpose of the present invention is to create a new pressing technique, which makes it possible to press a pyrotechnical charge, for example an illuminating charge, at high pressures, even into cases with low strength, for example pasteboard cases, without these being creased or cracked, and without necessitating the use of special films. The new method and device have then obtained the characteristics indicated in the accompanying claims in which the illuminating charge is precompacted before being inserted into the case.

BRIEF DESCRIPTION OF DRAWINGS

In the following, the invention will be described in more detail, with reference to the accompanying drawings, which schematically show the conditions on various occasions during a pressing operation, at single compacting, FIGS. 1–5, and at double-action compacting, FIGS. 6 and 7.

BEST MODE FOR CARRYING OUT THE INVENTION

Figures 1, 2, 3, 4, 5:
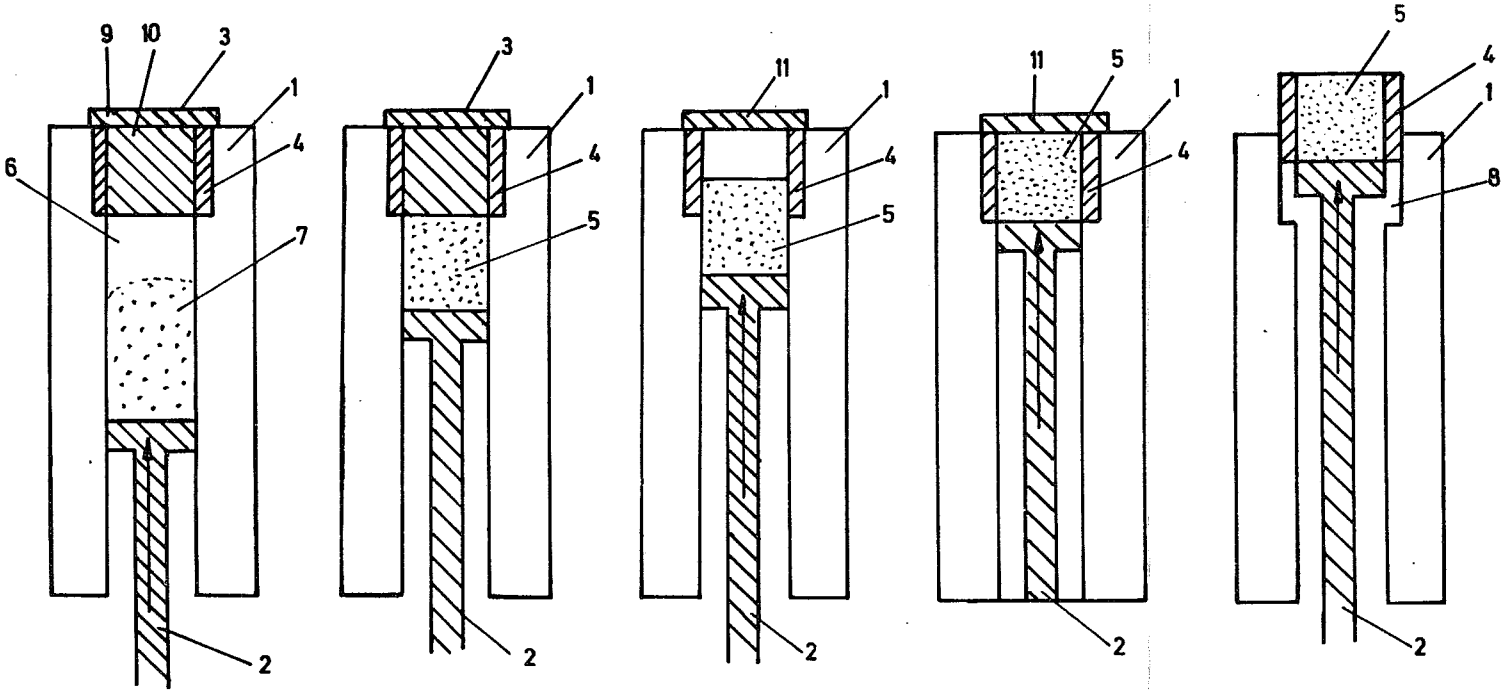
In FIG. 1, the precompacting has just started.
FIG. 2 shows the final stage of the precompacting.
FIG. 3 shows the insertion of the precompacted illuminating charge into the case.
FIG. 4 shows the final compacting.
FIG. 5 shows the finished illuminating charge being pressed out of the tool.

In FIGS. 1–7, all parts which are identical have been given the same reference designations. Thus, the pressing tool comprises a tubular main part or chamber 1, its movable lower plunger 2, an upper plunger 3 for precompacting, the pasteboard case 4, and the illuminating charge 5. From FIGS. 1–5, it will be noted that internally the pressing tool has a space 6, which is closed at its bottom by the movable lower plunger 2, and at the top by a removable upper plunger 3. In FIG. 1, the illuminating charge 5 is in the form of a powdered or granulated material 7, and is inserted in the space 6 between the two plungers. At the top of the space 6 there is a section 8 with an enlarged diameter, so that a circular, tubular space is formed, which is adapted to receive the pasteboard case 4. Space 6 has a length axially which corresponds to the length of the pasteboard case, and a thickness which corresponds to the thickness of the pasteboard case, so that the cylindrical outer surface of the pasteboard case is in contact with the inner wall of the section 8 with the enlarged diameter. The inner surface of the pasteboard case will thereby form a direct continuation of the inner surface of the tubular part, i.e. with approx. the same inner diameter as this. The upper plunger 3, which forms a counter support at the precompacting of the illuminating charge, has a part 9 which is in contact with the end surfaces of the pasteboard case and the tubular part, and a part 10 which extends into the tubular main part with a length corresponding to the length of the pasteboard case. During the precompacting, the inside of the pasteboard case is entirely filled up by the part 10. When the illuminating charge after the precompacting is inserted in the pasteboard case and during the final compacting, the upper plunger is replaced by a pressing disk 11, which is in contact with the end surfaces of the pasteboard case and the tubular part, and thereby retains the pasteboard case in its position.

The device described functions in the following way. The inner space of the tool is filled with a powdered illuminating charge material, after which the pasteboard case 4 and the upper plunger 3 are placed in their positions. Thereafter a precompacting of the illuminating charge takes place by the lower plunger 2 being displaced axially, as indicated by the arrow in FIG. 1. The precompacting pressure can normally constitute 40–100% of the pressure which is required in order to obtain an acceptably compacted body.

When the precompacting has been completed (see FIG. 2), the upper plunger 3 is replaced by the pressing disk 11. The inside of the pasteboard cylinder is then empty, while the illuminating charge consists of a cylindrical body with flat end surfaces. The illuminating charge is thereafter inserted into the pasteboard case by the lower plunger 2 being further displaced axially (see FIG. 3) until the pressing disk 11 forms a counter support. As the precompacting pressure is normally lower than the normal pressing pressure, also the pressure required for pressing it out will be lower. This involves less risk for ignition of the illuminating charge when this is subjected to friction against the inner surface of the pressing tool when it is inserted in the pasteboard case.

In FIG. 4, the illuminating charge is entirely inserted in the pasteboard case, and the final compacting takes place by the lower plunger 2 being further displaced axially, see arrow, with the full compacting pressure. Since the illuminating charge has been precompacted outside the case, the pressing movement in the case with the maximum precompacting pressure will amount to only approx. 1% of the pressing movement which would otherwise be necessary. With this minimal pressing movement, creases and other damage to the pasteboard case are avoided.

Finally, the finished illuminating charge is pressed out of the pressing tool (see FIG. 5). This pressing out takes place with the aid of the lower plunger 2, which is displaced axially in the same direction as previously. As the friction now arises between the insulating case and the inner walls of the pressing tool, this movement can take place without any risk of ignition.

Figures 6, 7:
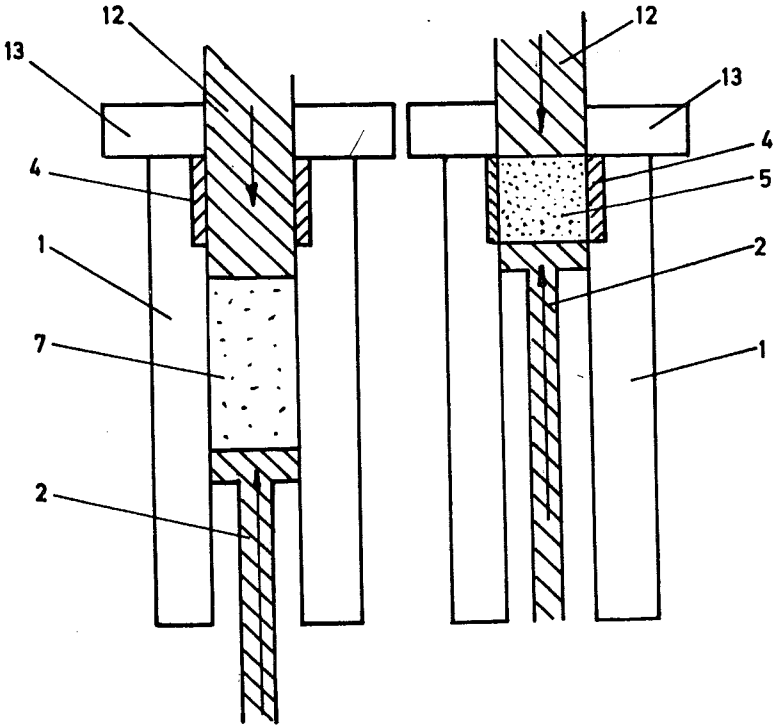
FIGS. 6 and 7 show precompacting and final compacting, respectively, of an illuminating charge by means of double-action compacting.

In the foregoing, the pressing operation has been described in the form of a single compacting, i.e. with one movable plunger. However, it is also possible to use double-action compacting (see FIGS. 6 and 7). In this case, the upper plunger also has been made axially movable. In FIG. 6, which corresponds to FIG. 1, precompacting of the illluminating charge is shown, at which both the upper plunger 12 and the lower plunger 2 are displaced axially (see arrows). The upper plunger 12 runs through a supporting ring 13 placed over the upper end surface of the pressing tool, which forms a support for the pasteboard case when the illuminating charge after the precompacting is inserted in the case.

FIG. 7, which corresponds to FIG. 4 at single compacting, shows the final compacting of the illuminating charge through double-action compacting with the upper and lower plungers. The advantage of the double-action compacting is that a higher final density can be achieved, as the energy losses resulting from friction are reduced.

In order to further increase the final density of the illuminating charge, the compacting can be carried out under vacuum. By connecting the inner space 6 of the pressing tool to a source of vacuum, the counter-pressure of the enclosed gas is reduced considerably, which involves an increased density of the finished illuminating charge.

INDUSTRIAL APPLICABILITY

The invention is not limited to the embodiments shown above as examples, but can be subjected to modifications within the scope of the following claims. Thus, it is not only for the manufacture of illuminating charges, but also for other types of pyrotechnical charges where the requirements for strength and burning properties are stringent, for example smoke charges, for which the new pressing technique can be utilized.

We claim:

1. A method of pressing pyrotechnical charges such as illuminating charges, comprising the steps of:

providing a tubular pressing chamber having a space for accommodating a case for a charge;

placing a quantity of charge material in said chamber;

precompacting said charge material within said chamber but outside said case;

inserting said charge material into said case following said precompacting;

final compacting said charge within said case; and pressing said case and said charge from said chamber.

2. A method according to claim 1, wherein said precompacting takes place at a pressure not exceeding that required for acceptable compaction of the charge material.

3. A method according to claim 1, wherein said precompacting takes place at a pressure between 40 and 100% of that required for acceptable compaction of the charge material.

4. A method according to claim 1, wherein said pressing chamber comprises a tubular part having at least one plunger movable therein, said precompacting, inserting, final compacting and pressing steps being effected using said plunger.

5. An apparatus for pressing pyrotechnical charges, comprising:

a tubular pressing chamber having a space for accommodating a case for a charge; and means coacting with said chamber for precompacting a quantity of charge material within said chamber but outside said case; for inserting a precompacted charge into said case and there final compacting it; and for pressing the case and final compacted charge from said chamber.

6. Apparatus according to claim 5, wherein said means comprises a first plunger movable axially in said chamber, a second plunger located in said chamber and arranged to form a counter support during said precompacting and a pressing disk arranged to form a counter support during said final compacting.

7. Apparatus according to claim 5, wherein said means comprises first and second plungers movable axially in said chamber for double-acting compaction of the charge.

8. Apparatus according to claim 6, wherein said second plunger comprises a radially extending portion which contacts the surface of one end of the case and an axially extending portion which is inserted into said chamber to fill the interior of the case.

9. Apparatus according to claim 6, wherein said pressing disk contacts the surface of one end of the case and the tubular chamber.

* * * * *